US005159905A

United States Patent [19]

Sugiuchi et al.

[11] Patent Number: 5,159,905

[45] Date of Patent: Nov. 3, 1992

[54] VARIABLE CAM ENGINE

[75] Inventors: Masashi Sugiuchi; Hiroshi Kamiyama, both of Yokohama, Japan

[73] Assignee: Nissan Motor Co., Ltd., Yokohoma, Japan

[21] Appl. No.: 767,335

[22] Filed: Sep. 30, 1991

[30] Foreign Application Priority Data

Oct. 3, 1990 [JP] Japan ..... 2-265995

[51] Int. Cl.[5] ..... F01L 1/34

[52] U.S. Cl. ..... 123/90.16; 123/90.15

[58] Field of Search ..... 123/90.15, 90.16, 90.17

[56] References Cited

U.S. PATENT DOCUMENTS 4,887,561 12/1989 Kishi ..... 123/90.16
4,887,563 12/1989 Ishida et al. ..... 123/90.16
4,926,804 5/1990 Fukuo ..... 123/90.16

FOREIGN PATENT DOCUMENTS 63-167016 7/1988 Japan .

*Primary Examiner*—E. Rollins Cross
*Assistant Examiner*—Weilun Lo
*Attorney, Agent, or Firm*—Lowe, Price, LeBlanc & Becker

[57] ABSTRACT

A variable cam engine comprises a low speed power cam arranged so as to generate high power at low engine speeds, a high speed power cam arranged so as to generate high power at high engine speeds, and an economy cam arranged so as to give good fuel cost performance. The engine is provided with a device for detecting the running condition of the engine, a device for identifying a target cam from among the cams depending on the running condition of the engine, a device for identifying a present cam, a device for selecting either the target cam or another cam depending on whichever gives the smaller torque step with respect to the present cam, and a device for transmitting the motion of the cam selected to a valve. In the above construction, when there is a large torque step between the present cam and the target cam, cams can be changed over via a cam intermediate between the two. The torque step when the cams are changed over is therefore reduced, and the change-over to the target cam proceeds smoothly.

10 Claims, 8 Drawing Sheets

VARIABLE CAM ENGINE

FIELD OF THE INVENTION

This invention relates to an engine wherein the characteristics of the cams driving the air intake and exhaust valves can be selected according to the running condition of the engine.

BACKGROUND OF THE INVENTION

The cams which drive air intake and exhaust valves of an engine are designed such that the valve timing is optimized with respect to the characteristics required by the engine.

This optimum valve timing however depends on the running condition of the engine. On low load, for example, a small valve lift amd valve opening period are required, while on high load a large valve lift and valve opening period are required. In particular, in the case of automoble engines which have a wide range of running conditions it is impossible to have optimum matching in all cases, and it is therefore by no means easy to set the valve timing to suit the running conditions.

In Tokkaisho 63-167016 published by the Japanese Patent Office, a variable cam engine is proposed wherein several cams with different shapes are provided, and the optimum valve timing is obtained by selecting these cams depending on the engine running conditions.

This engine is designed to give high power over the whole range of speeds, i.e. from low speed to high speed, by changing from a low speed cam which gives hhigh torque at low speed to a high speed cam which gives high torque at high speed or vice versa depending on the running conditions.

In order that the engine output torque does not vary discontinuously, this change-over between cams is made at a certain engine speed chosen such that the output torques of the cams is the same for the same throttle opening.

However, if for example two cams are provided having shapes which respectively maximize the power (torque) at low speed and high speed (power cams), and another can is provided to improve fuel comsumption performance on partial load (economy cam), there is still a very large difference of output torque for a given throttle opening when a change-over is made from the economy cam to the power cams, or vice versa.

This is due to the fact that there is no engine speed at which the output torques of the economy cam and the pcwer cams conincide for the same throttle opening.

To solve this problem, the torques can be made to ccincide by having an arrangement wherein the throttle valve opening can be controlled independently of the accelerator pedal, and the throttle opening or ignition timing are automatically compensated by an amount sufficient to absorb the torque step as judged from the throttle opening or engine speed when the change-over is made. When changing over from the economy cam to the power cams, for example, the torque increases rapidly if the throttle opening is not changed, so the throttle valve opening is reduced or the ignition timing is temporarily retarded.

However, depending on the running conditions when the change-over is made, the amount by which the throttle opening has to be compensated may be extremely large. Further, however rapidly the compensation is made, there will be a response delay until the torque reaches the target value. It is thus impossible to avoid a torque shock when the change over is made.

SUMMARY OF THE INVENTION

It is therefore an object of this invention to make the torque shock when the economy cam is changed over to the power cams, and vice versa, as small as possible.

A further object of this invention is to obtain optimum running conditions from the cam which is selected.

To achieve these objects, this invention provides an engine with a valve driven by cams which rotate in synchronism with the engine revolution, comprising a low speed power cam arranged such that it generates high power in the low speed region, a high speed cam arranged such that it generates high power in the high speed region, an economy cam arranged such that it gives good fuel consumption performance, means for detecting the running condition of the engine, means for identifying a target cam from among the cams according to the engine running condition detected, means for identifying a present cam, means for selecting either the target cam or another cam depending on whichever gives the smaller torque step with respect to the present cam, and a cam change-over mechanism which transmits the motion of the selected cam to the valve.

Further this invention also preferably provides means which shifts the operation to the target cam after a predetermined time if the selected cam is different from the target cam.

DESCRIPTION OF THE PREFERRED EMBODIMENTS

Figure 1:
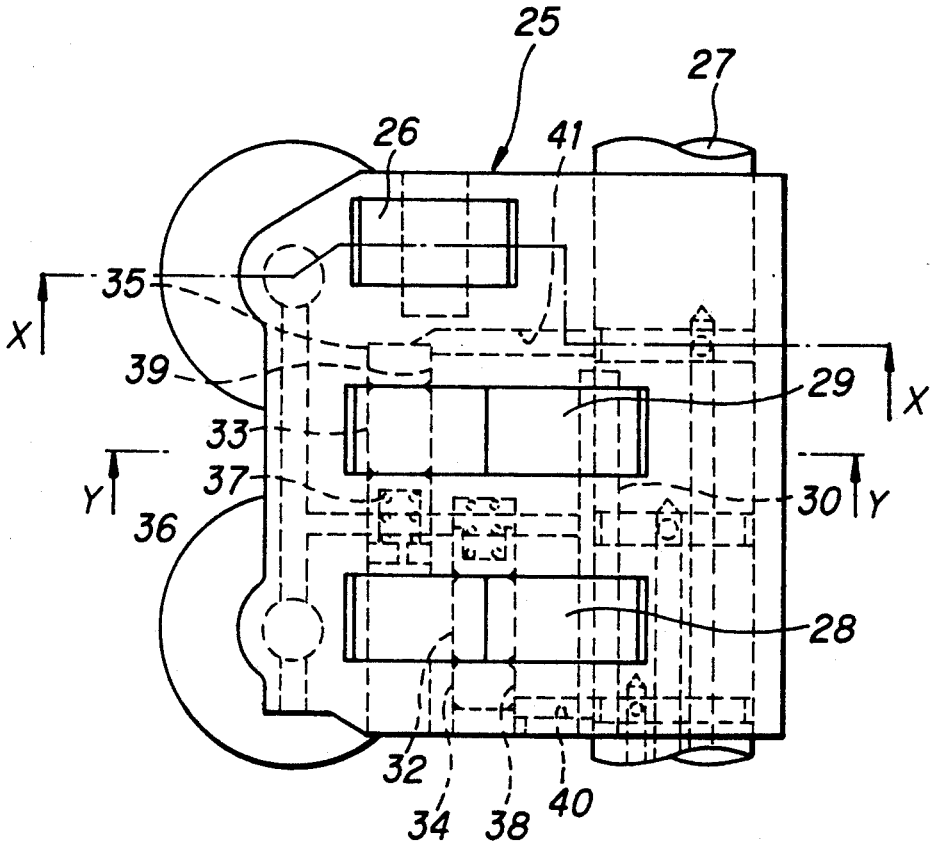
FIG. 1 is a plan view of the engine cam selecting mechanism according to this invention.
Figure 2:
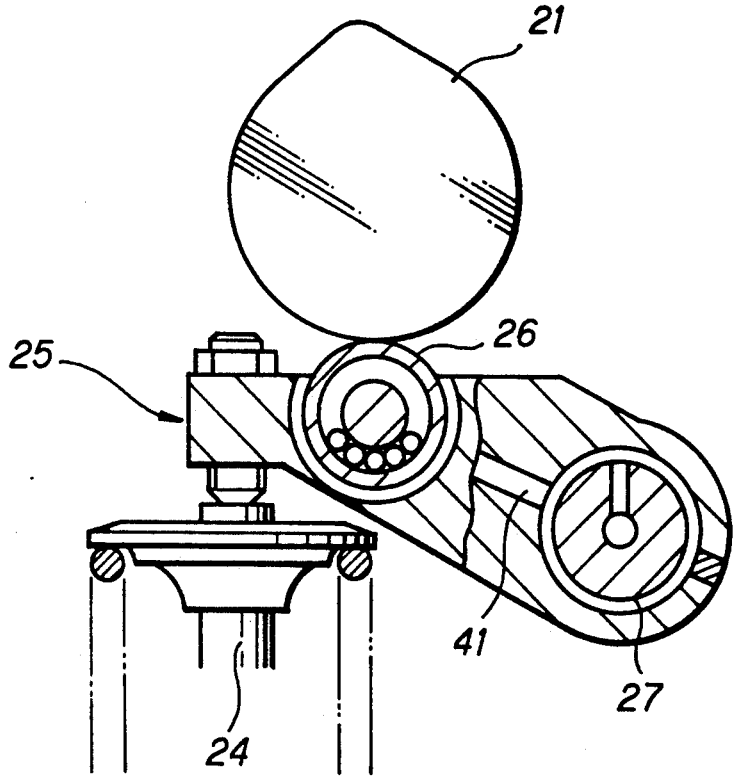
FIG. 2 shows a section through the line X—X in FIG. 1
Figure 3:
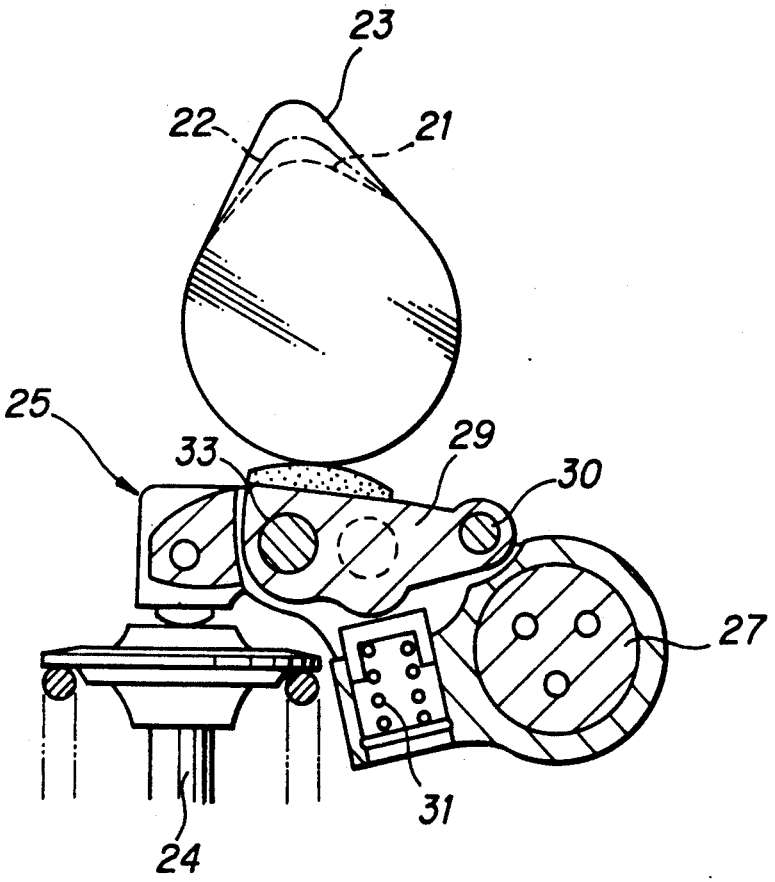
FIG. 3 shows a section through the line Y—Y in FIG. 1.

FIGS. 1, 2 and 3 show the structure of the cam selecting mechanism.

A first cam (economy cam) 21 has both a small cam lift amount and lift period, and it has a shape which emphasizes fuel cost performance. A second cam (low speed power cam) 22 has a larger cam lift and lift period than the first cam 21, and it has a shape which generates a high torque at low speeds. A third cam (high speed power cam) 23 has a still higher lift amount and lift period than the second cam 22, and it has a shape which generates high torque at high speeds. These cams 21, 22, 23 are arranged in series on a same cam shaft.

An air intake valve (or exhaust valve) 24 is opened and closed by a main rocker arm 25 which pivots about a rocker arm. shaft 27. A roller 26 is attached to the main rocker arm 25 such that it is free to rotate. When the first cam 21 which is in contact with this roller 26 rotates, it drives the main rocker arm 25.

Two sub-rocker arms 28, 29 are supported by the main rocker arm 25 and arranged parallel to one another on one side of the roller 26 such that they can pivot about the shaft 30. The sub-rocker arm 28 is in contact with the second cam 22, while the sub-rocker arm 29 is in contact with the third cam 23.

A cylindrical pin 32 is inserted in a passage running horizontally through the sub-rocker arm 28, and another pin 34 of similar cross-section is inserted such that it is free to slide in a hydraulic chamber 38 formed in the main rocker arm 25. This pin 34 is coaxial with the pin 32 when the sub-rocker arm 28 is at a base oscillating position which corresponds to the base of locus followed by the second cam 22.

A return spring 36 is provided in the main rocker arm 25 on the other side of pin 32 opposite to the pin 34 such that it pushes the pin 32 towards the pin 34 when the sub-rocker arm 28 is in the base oscillating position.

The pins 32 and 34 under the force of the return spring 36 are kept inside of the sub-rocker arm 28 and main rocker arm 25 respectively as shown in FIG. 1 so as to permit free oscillation of the sub-rocker arm 28. When pressurized oil is led into the hydraulic chamber 38 via a passage 40, however, the pins 32 and 34 are pushed together against the force of the return spring 36 and the pin 32 partially enters the main rocker arm 25 so that the sub-rocker arm 28 engages with the main rocker arm 25. Similarly, the sub-rocker arm 29 is engaged with the main rocker arm 25 by an engaging mechanism comprising pins 33 and 35, and a return spring 37.

The sub-rocker arms 28 and 29 are pushed towards the second cam 22 and the third cam 23 respectively by springs 31 provided on the main rocker arm 25. When they are not engaged with the main rocker arm 25, they pivot about shaft 30 due to contact with the second and third cams independently of the main rocker arm 25.

When the first, second and third cams are in contact with the roller 26, sub-rocker arms 28 and 29 respectively at their bases of loci, the air intake valve 24 closes whichever cam is selected. If the second cam 22 is selected and pressurized oil is supplied to the hydraulic chamber 38 to drive the pins 32 and 34, therefore, the sub-rocker arm 28 in its base oscillating position engages with the main rocker arm 25, and after that the air intake valve 24 opens and closes with a timing determined by the second cam 22 which has a greater lift amount than the first cam 21.

In other words, there is a change-over from an emphasis on fuel cost performance by the first cam 21, to an emphasis on power in the low speed region by the second cam 22.

If the third cam 23 is selected and pressurized oil is supplied to the hydraulic chamber 39 via a passage 41, the pins 35 and 32 are pressed against the force of the return spring 37, and the sub-rocker arm 29 engages with the main rocker arm 25. The valve timing of the air intake valve 24 then depends on the third cam 23 which has a greater lift amount and lift period than the second cam 22, and the operating characteristics then emphasize output in the high speed region.

Figure 4:
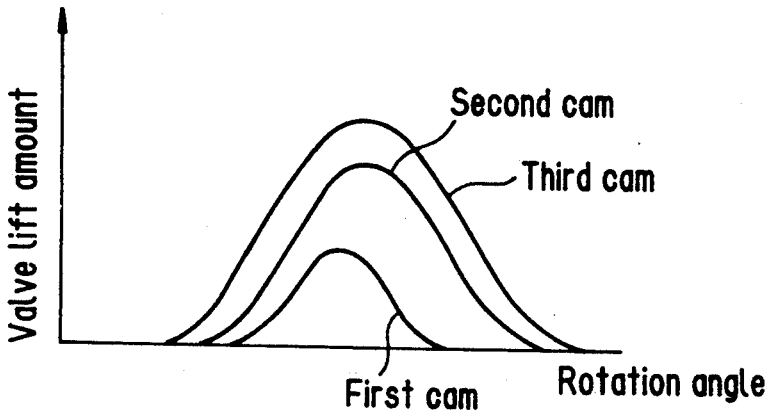
FIG. 4 is a graph showing the lift characteristics of each engine cam according to this invention.
Figure 5:
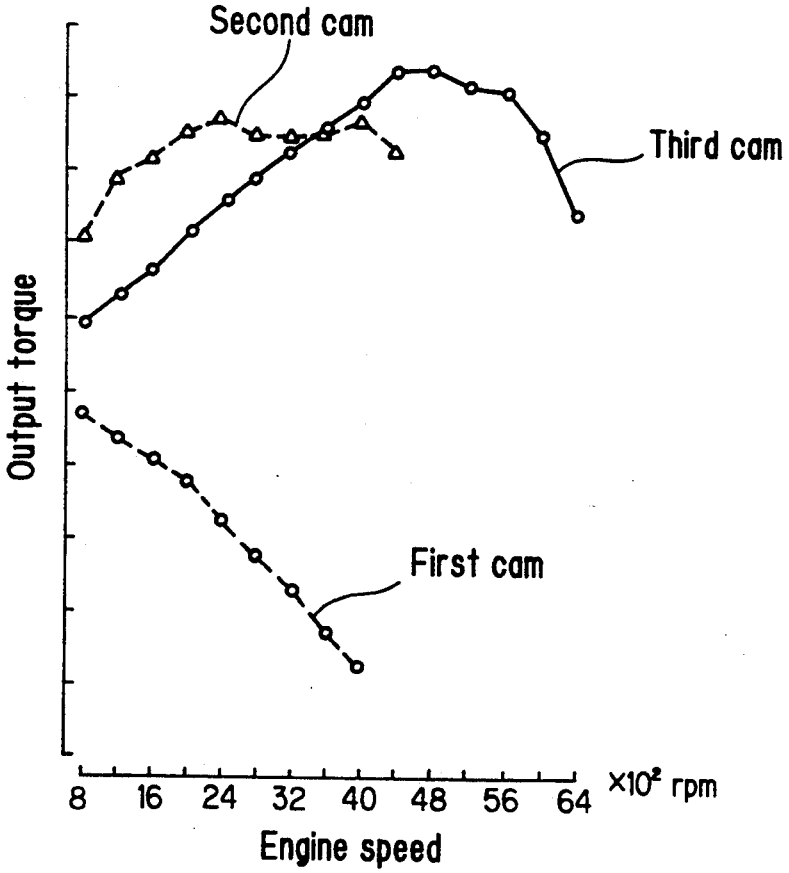
FIG. 5 is a graph showing the output characteristics on full throttle based on each engine cam according to this invention.

The valve lift characteristics of the cams 21, 22 and 23 are shown in FIG. 4, and the egine output characteristics due to cams 21, 22 and 23 when the engine is on full throttle are shown in FIG. 5. The first cam 21 generates low torque, but it gives good fuel cost performance. The second cam 22 provides the maximum torque in the low speed region. The third cam 23 generates less torque at low speeds, but provides the maximum torque in the high speed region.

Figure 6:
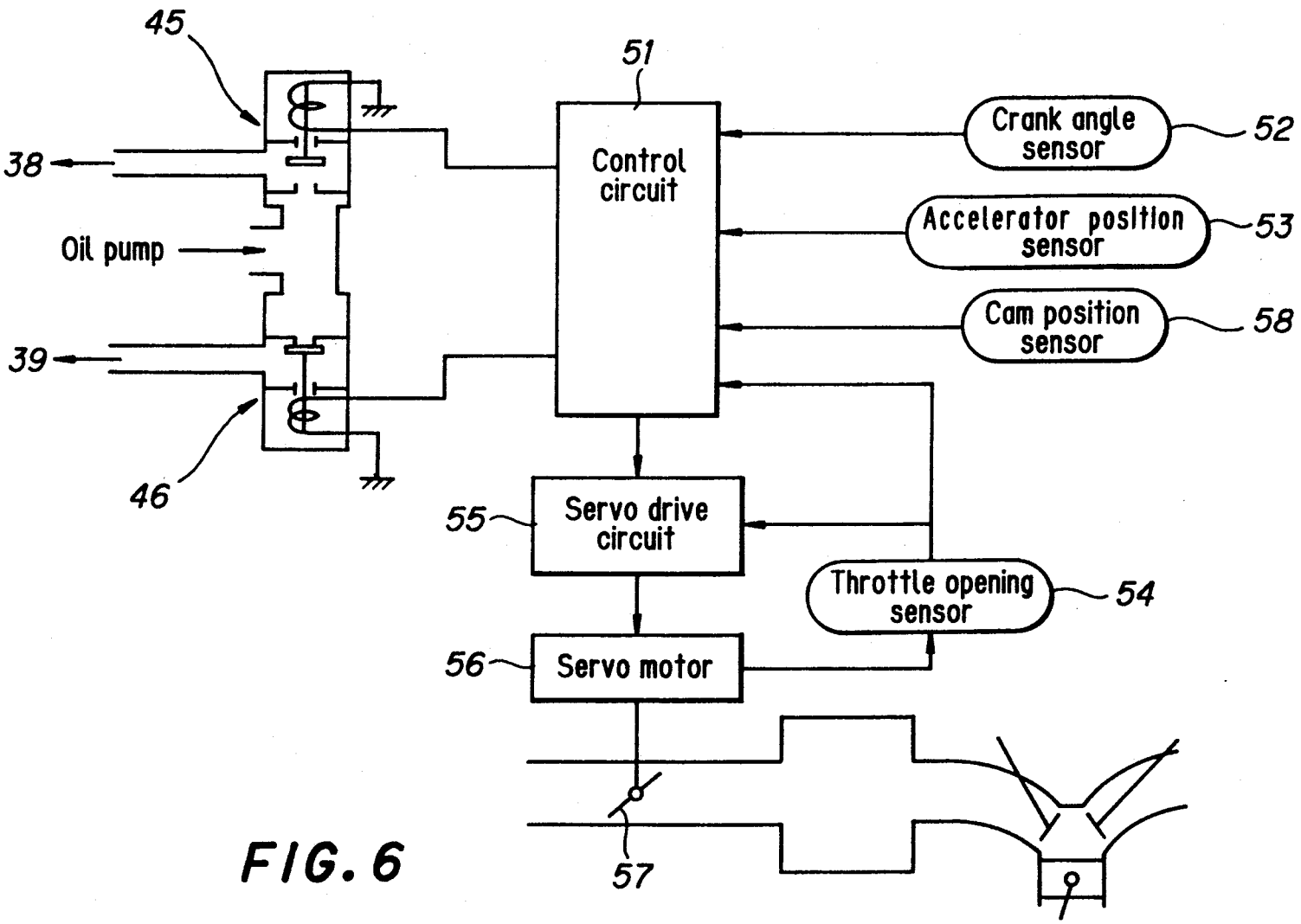
FIG. 6 is a block diagram showing the structure of the engine control system according to this invention.

The change-over from the first cam 21 to the second and third cams 22 and 23, or from the second and third cams 22 and 23 to the first cam 21, is controlled by the control unit 51 shown in FIG. 6 depending on the engine running condition.

Signals from a crank angle sensor 52 which detects the engine speed, an accelerator position sensor 53 which detects the operating position (depression) of the accelerator, and a cam position sensor 58 which identifies the cam actually selected, are input to the control unit 51. Based on these signals, the control unit 51 controls sluice valves 45, 46 to change over the oil supply between said hydraulic chambers 38, 39.

When the sluice valve 45 is opened, pressurized oil is led from the oil pump to the hydraulic chamber 38 to operate the second cam 22. When the other sluice valve 46 is opened, however, pressurized oil is led to the hydraulic chamber 39 to operate the third cam 23.

Further, when the control unit 51 changes over between the cams 21, 22 and 23, a large torque step is produced by the engine if the throttle opening is not changed. This torque step adversely affects engine performance and causes the chassis to vibrate. To avoid this occurrence, the control unit 51 controls the opening of a throttle valve 57 provided in teh air intake passage 59 of the engine when a change-over is made between the cams 21, 22 and 23.

The opening of the throttle valve 57 is adjusted independently of the accelerator pedal via a servo drive circuit 55 which receives signals from the control unit 51, and a servo motor 56 which operates according to these drive signals. At the same time, the actual opening of the throttle valve 57 is fed back to the control unit 51 via a throttle opening sensor 54.

Thus, when a change-over is made from the first cam 21 to the second or third cams 22 or 23, the control unit 51 reduces the opening of the throttle valve 57 via the servo drive circuit 55 and the servo motor 56 so as to minimize the torque step between the target cam and the first cam. On the other hand, when a change-over is made from the second or third cams 22 or 23 to the first cam 21, the opening of the throttle valve 57 is increased to absorb the torque step.

Figure 7:
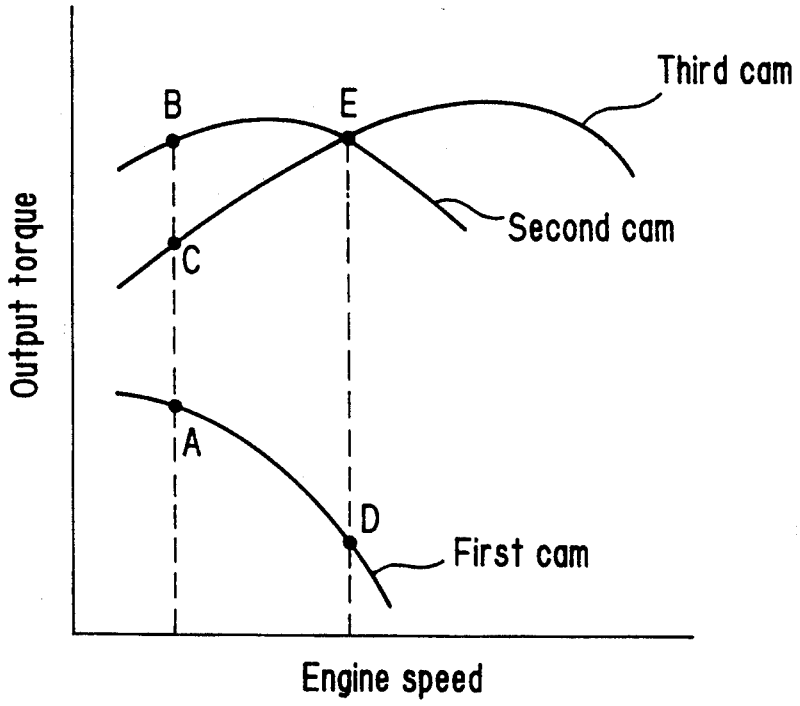
FIG. 7 is graph showing the engine cam selection timing according to this invention.

The control unit 51 changes operation over to the cam which gives the smaller torque step. When a change-over is made from the first cam 21 which emphasizes fuel cost performance to the second or third cams 22 or 23 which emphasize output, for example, the final target cam is the second cam 22 if the engine speed is lower than the point E shown in FIG. 7. However, as the output torque of the third cam 23 is smaller than that of the second cam 22, a change-over is made first from the first cam 21 to the third cam 23, and then to the second cam 22 as shown by the process A→C→B in the figure. If the engine speed is higher than the point E, on the other hand, the target cam is the third cam 23, but as the output torque of the second cam 22 is smaller than that of the third cam 23, a change-over is made first from the first cam 21 to the second cam 22, and then to the third cam 23.

The change-over to the target cam is based on the accelerator opening position and the engine speed. The target cam is determined based on the characteristic graph of FIG. 7 with the required torque obtained from the accelerator opening position and the engine speed at that time. In principle, this means that when a change-over is made from the first cam 21 to the second or third cams 22 or 23, the cam which gives the highest torque in that engine speed region is chosen. If the speed is lower than point E in FIG. 7 where the torques generated by the second cam 22 and the third cam 23 are equal, therefore, the second cam 22 will be the final choice, while if the speed is higher than point E, the third cam 23 will be the final choice. The process A→C→B mentioned heretofore, for example, is simply a transient control to absorb the torque step when a change-over is made.

Figure 8:
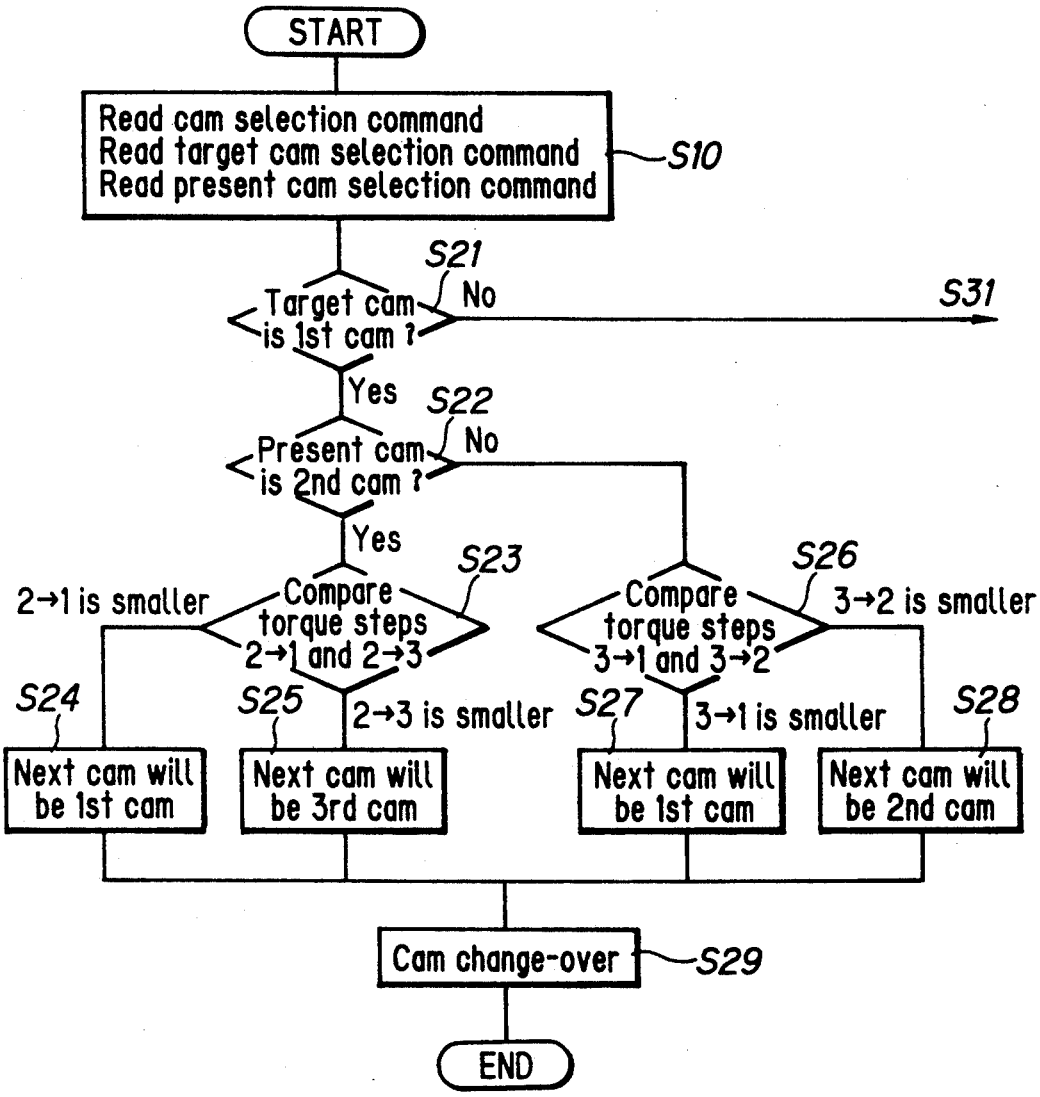
FIGS. 8 and 9 are cam selection control flowcharts executed by the engine control unit according to this invention.
Figure 9:
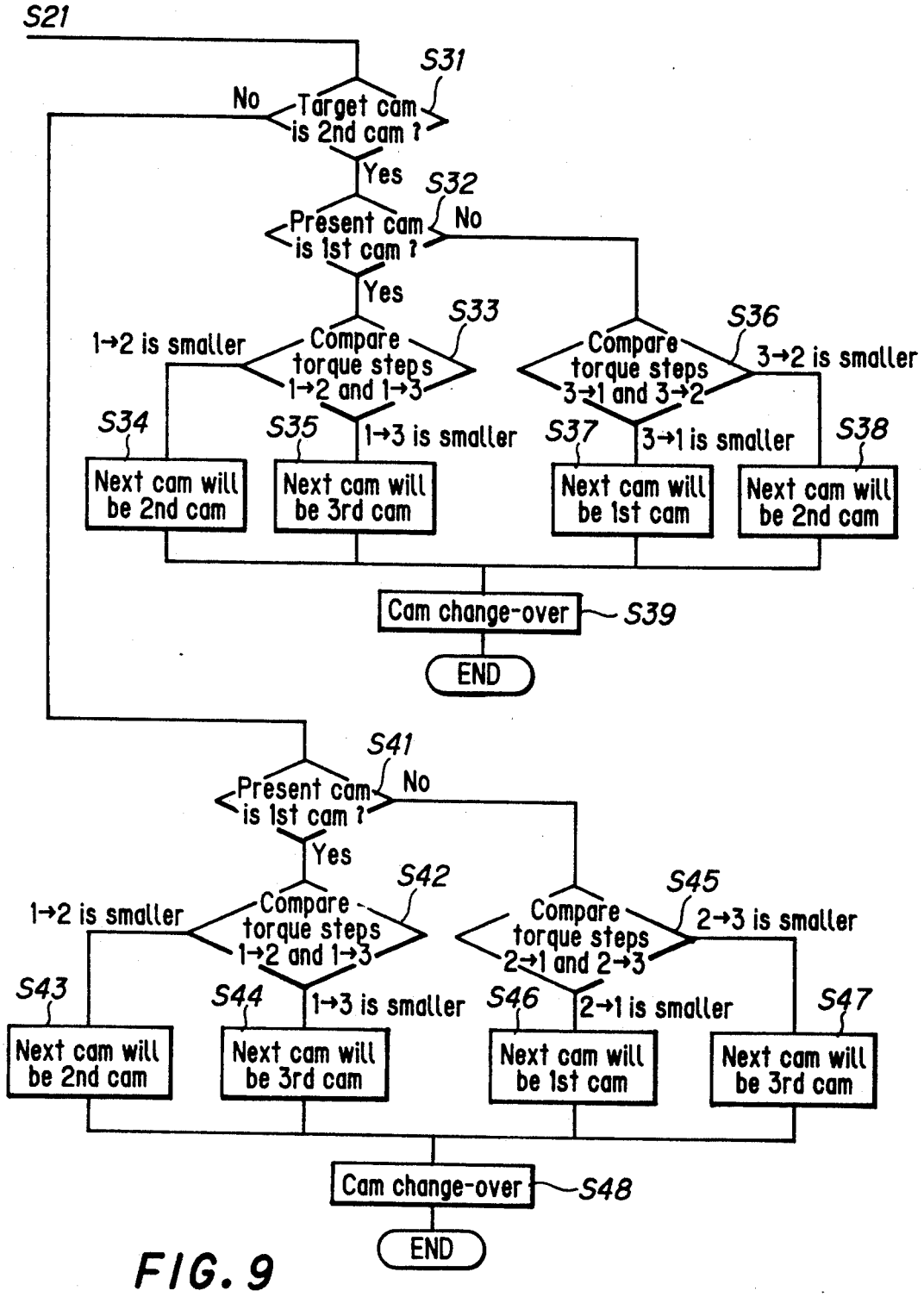

FIGS. 8 and 9 are flowcharts to control the cam change-over performed by the control unit 51.

In a step 10, a cam selection command, the target cam and the present cam are read in. In a step 21, if the target cam selected is the first cam, there will be a change-over from the power cams to the economy cam accompanied by a decleration, and the program follows steps S22–29.

If on the other hand the cam selected in the step 21 is not the first cam, there will be a change-over from the economy cam to the power cams accompanied by an acceleration, and it is determined in a step S31 whether the cam selected is the second cam or the third cam. If the cam selected is the second cam the program follows steps S32–39, while if it is the third cam the program follows steps S41–48.

If it is determined in the steps 21, 22 that the target cam is the first cam and the present cam is the second cam, the torque step between the second cam and the two other cams is determined. In other words, the torque step between the second cam and the first cam is compared with the torque step between the second cam and the third cam, and either the first or the third cam is chosen depending on whichever gives the smaller torque step (S24, 25).

If the present cam is third cam, the torque step is determined in a similar way in a step 26, and either the first cam or the second cam is chosen depending on whichever gives the smaller torque step (S27, 28).

If the target cam is the second cam, it is determined in a step 32 whether the present cam is the first cam or the third cam. If it is the first cam, either the second or third cam is chosen depending on whichever gives the smaller torque step (S33–35).

If it is determined in a step S32 that the present cam is the third cam, the torque steps with respect to the first and second cams are determined, and either is chosen depending on whichever gives the smaller torque step (S36–38).

If on the other hand the target cam is the third cam, it is determined in a step 41 whether the present cam is the first cam or the second cam. If it is the first cam, either the second or third cam is chosen depending on whichever gives the smaller torque step (S42–44). If it is the second cam, either the first or the third cam is chosen depending on whichever gives the smaller torque step (S45–47).

A change-over is then made to the cam which has been selected by the above procedure (S29, 39, 48).

When the running condition of the engine is changed over from an emphasis on fuel cost performance to an emphasis on torque or vice versa, therefore, the cam is chosen which gives the smaller torque step when the change-over is made. If the cam selected is the target cam, moreover, control of the change-over is terminated at that time, but if it is not the target cam, the program continues to shift to the target cam.

The torque step produced when changing over cams is thus reduced, and if in addition to this the opening of the throttle valve 57 is compensated or the ignition period is compensated, torque fluctuations can be reduced still further.

When the first cam 21 is changed over to the second cam 22 or third cam 23, the opening of the throttle valve 57 is compensated so as to reduce the torque step with the selected target cam and absorb excess torque, while on the other hand, when the second or third cam is changed over to the first cam, the opening of the throttle valve 57 is increased to absorb the torque step.

If the ignition period is also delayed when performing these controls, the absorbing effect is enhance. Thus, by performing cam selection in steps and choosing the cam that gives the smaller torque step, amount of compensation of the throttle valve opening and ignition timing can also be reduced compared to the prior art where the change-over was made abruptly to the target cam. This provides some measure of leeway when making the compensation, and enables torque fluctuations to be absorbed efficiently during the change-over.

In the preceding description, the drive system for the air intake valve was used as an example, but the same effect is obtained if this invention is applied to the exhaust valve.

The foregoing description of a preferred embodiment for the purpose of illustrating this invention is not to be considered as limiting or restricting the invention, since many modifications may be made by the exercise of skill in the art without departing from the scope of the invention.

The embodiments of the invention in which an exclusive property or privilege is claimed are defined as follows:

1. A variable cam engine with a valve driven by cams which rotate in synchronism with the engine revolution, comprising:

a low speed power cam arranged so as to generate high power in the low speed region, a high speed power cam arranged so as to generate high power in the high speed region, an economy cam arranged so as to give good fuel cost performance, means for detecting the running condition of the engine, means for identifying a target cam from among said cams depending on the engine running condition detected by said running condition detecting means, means for identifying a present cam, means for selecting either a target cam or another cam, depending on whichever gives the smaller torque step with respect to the present cam identified by said present cam identifying means, and a cam change-over mechanism which transmits the motion of the selected cam to said valve instead of the present cam.

2. A variable cam engine as defined in claim 1 wherein said valve is an air intake valve.

3. A variable cam engine as defined in claim 1 wherein said valve is an exhaust valve.

4. A variable cam engine as defined in claim 1 wherein said cam change-over mechanism comprises rocker arms interposed between said cams and valve, and connecting means which selectively transmits a movement of said rocker arms to sad valve.

5. A variable cam engine as defined in claim 4 wherein said rocker arms comprise a main rocker arm and two sub-rocker arms supported such that they are free to pivot on said main rocker arm, said economy cam is in contact with said main rocker arm and said power cams are in contact with the sub-rocker arms, and said connecting means comprises pins which engage the sub-rocker arms with the main rocker arm, hydraulic chambers which drive the pins, and sluice valves which control the supply of pressurized oil to said hydraulic chambers.

6. A variable cam engine as defined in claim 1 wherein said engine running condition detecting means comprises a crank angle sensor which detects the engine speed, and an accelerator operating position sensor.

7. A variable cam engine as defined in claim 6 wherein said cam selecting means selects the cam which gives the smaller torque step based on the engine speed detected by said crank angle sensor when a target cam is identified by said target cam identifying means.

8. A variable cam engine as defined in claim 1 further comprising:

a servo motor which adjusts the opening of an engine throttle valve, and means which drives said servo motor to eliminate the torque step between the target cam identified by said target cam identifying means and the present cam identified by said present cam identifying means.

9. A variable cam engine as defined in claim 8 wherein said servo motor drive means controls the opening of said throttle valve in synchronism with said cam selection.

10. A variable cam engine as defined in claim 1 further comprising:

shift means which changes over to the target cam after a predetermined time if the cam changed over by said cam change-over mechanism is not the target cam.

* * * * *